US007941091B1

(12) United States Patent
Doherty et al.

(10) Patent No.: US 7,941,091 B1
(45) Date of Patent: May 10, 2011

(54) SIGNAL DISTRIBUTION SYSTEM EMPLOYING A MULTI-STAGE SIGNAL COMBINER NETWORK

(75) Inventors: Peter Doherty, San Diego, CA (US); John Kitt, San Diego, CA (US); Jeremy Goldblatt, San Diego, CA (US)

(73) Assignee: RF Magic, Inc., San Diego, CA (US)

( * ) Notice: Subject to any disclaimer, the term of this patent is extended or adjusted under 35 U.S.C. 154(b) by 868 days.

(21) Appl. No.: 11/763,359

(22) Filed: Jun. 14, 2007

Related U.S. Application Data

(60) Provisional application No. 60/805,134, filed on Jun. 19, 2006.

(51) Int. Cl.
*H04H 20/71* (2008.01)

(52) U.S. Cl. ..... 455/3.01; 455/272; 455/500

(58) Field of Classification Search ..... 455/3.01
See application file for complete search history.

(56) References Cited

U.S. PATENT DOCUMENTS 3,761,916 A * 9/1973 Schenck ..... 341/111
3,792,473 A * 2/1974 Sawicki ..... 342/401
3,944,749 A * 3/1976 Kahn ..... 381/15
4,079,318 A * 3/1978 Kinoshita ..... 455/139
4,720,673 A * 1/1988 Hatfield ..... 324/76.23
5,325,401 A * 6/1994 Halik et al. ..... 375/329
5,515,173 A * 5/1996 Mankovitz et al. ..... 386/131
5,528,633 A * 6/1996 Halik et al. ..... 375/326
5,532,829 A * 7/1996 Kawamura ..... 386/343
5,553,123 A * 9/1996 Chan et al. ..... 379/102.03
5,592,078 A * 1/1997 Giragosian et al. ..... 324/207.18
5,625,696 A * 4/1997 Fosgate ..... 381/18
5,790,287 A * 8/1998 Darcie et al. ..... 398/108
5,802,452 A * 9/1998 Grandfield et al. ..... 455/20
5,915,210 A * 6/1999 Cameron et al. ..... 455/59
6,061,405 A * 5/2000 Emami ..... 375/260
6,072,526 A * 6/2000 Hashimoto et al. ..... 348/223.1
6,108,317 A * 8/2000 Jones et al. ..... 370/320
6,112,070 A * 8/2000 Katsuyama et al. ..... 455/307
6,115,363 A * 9/2000 Oberhammer et al. ..... 370/277
6,249,317 B1 * 6/2001 Hashimoto et al. ..... 348/364
6,362,781 B1 * 3/2002 Thomas et al. ..... 342/383
6,522,752 B1 * 2/2003 Smith ..... 381/61
6,535,550 B1 * 3/2003 Cole ..... 375/222
6,606,171 B1 * 8/2003 Renk et al. ..... 358/475
6,639,463 B1 * 10/2003 Ghanadan et al. ..... 330/124 R
6,687,307 B1 * 2/2004 Anikhindi et al. ..... 375/260
6,725,017 B2 * 4/2004 Blount et al. ..... 455/67.13
6,735,416 B1 * 5/2004 Marko et al. ..... 455/3.02
6,735,452 B1 * 5/2004 Foster et al. ..... 455/562.1
6,735,734 B1 * 5/2004 Liebetreu et al. ..... 714/775
6,748,240 B1 * 6/2004 Foster et al. ..... 455/562.1
6,778,516 B1 * 8/2004 Foster et al. ..... 370/336

(Continued)

*Primary Examiner* — Yuwen Pan
*Assistant Examiner* — Hal V Nguyen
(74) *Attorney, Agent, or Firm* — Clifford Perry; Bruce W. Greenhaus

(57) ABSTRACT

A multi-stage signal combining network includes two or more first stage combiner circuits, two or more filters, and at least one second stage signal combiner circuit. Each of the first stage combiner circuits has two or more input ports coupled to receive a respective two or more signals, and a first combiner output port. Each of the two or more filters includes an input coupled to one first stage combiner output port and a filter output port. The at least one second stage combiner circuit includes two or more input ports, each coupled to one filter output port, and a second stage combiner output port.

21 Claims, 7 Drawing Sheets

U.S. PATENT DOCUMENTS 6,784,831 B1 * 8/2004 Wang et al. ..... 342/357.12
6,788,236 B2 * 9/2004 Erdogan et al. ..... 341/155
6,810,072 B1 * 10/2004 Akopian ..... 375/143
6,823,169 B2 * 11/2004 Marko et al. ..... 455/3.02
6,859,641 B2 * 2/2005 Collins et al. ..... 455/63.1
6,895,063 B1 * 5/2005 Cowley et al. ..... 375/376
6,914,558 B1 * 7/2005 Shirosaka et al. ..... 342/371
6,983,009 B2 * 1/2006 Lomp ..... 375/149
6,985,433 B1 * 1/2006 Laroia et al. ..... 370/208
6,993,016 B1 * 1/2006 Liva et al. ..... 370/356
7,020,111 B2 * 3/2006 Ozluturk et al. ..... 370/335
7,054,289 B1 * 5/2006 Foster et al. ..... 370/330
7,054,597 B2 * 5/2006 Rosnell ..... 455/110
7,072,380 B2 * 7/2006 Ozluturk et al. ..... 375/141
7,076,168 B1 * 7/2006 Shattil ..... 398/76
7,079,826 B2 * 7/2006 Muhammad et al. ..... 455/262
7,123,600 B2 * 10/2006 Ozluturk et al. ..... 370/335
7,130,576 B1 * 10/2006 Gurantz et al. ..... 455/3.02
7,139,543 B2 * 11/2006 Shah ..... 455/296
7,139,545 B2 * 11/2006 Drentea ..... 455/314
7,145,972 B2 * 12/2006 Kumar et al. ..... 375/349
7,228,104 B2 * 6/2007 Collins et al. ..... 455/63.1
7,243,287 B2 * 7/2007 Cameron et al. ..... 714/752
7,248,841 B2 * 7/2007 Agee et al. ..... 455/101
7,257,385 B2 * 8/2007 Ono et al. ..... 455/232.1
7,304,689 B2 * 12/2007 Englmeier ..... 348/731
7,317,750 B2 * 1/2008 Shattil ..... 375/146
7,362,829 B2 * 4/2008 Ojard ..... 375/346
7,403,577 B2 * 7/2008 Kumar ..... 375/324
7,430,257 B1 * 9/2008 Shattil ..... 375/347
7,436,902 B2 * 10/2008 Shen et al. ..... 375/308
7,464,317 B2 * 12/2008 Cameron et al. ..... 714/755
7,466,767 B2 * 12/2008 Chu et al. ..... 375/321
7,477,871 B1 * 1/2009 Gurantz et al. ..... 455/3.01
7,522,875 B1 * 4/2009 Gurantz et al. ..... 455/3.01
7,535,874 B2 * 5/2009 Ozluturk et al. ..... 370/335
7,542,715 B1 * 6/2009 Gurantz et al. ..... 455/3.01
7,573,398 B2 * 8/2009 Hoctor et al. ..... 340/870.12
7,593,449 B2 * 9/2009 Shattil ..... 375/130
7,616,556 B2 * 11/2009 Nystrom et al. ..... 370/208
7,639,728 B2 * 12/2009 Laroia et al. ..... 375/135
2003/0078011 A1 * 4/2003 Cheng et al. ..... 455/73
2003/0189974 A1 * 10/2003 Ferry ..... 375/219
2003/0227574 A1 * 12/2003 Englmeier ..... 348/731
2004/0021595 A1 * 2/2004 Erdogan et al. ..... 341/144
2005/0025220 A1 * 2/2005 Laroia et al. ..... 375/132
2005/0075088 A1 * 4/2005 Ono et al. ..... 455/251.1
2005/0159180 A1 * 7/2005 Cheng et al. ..... 455/552.1
2005/0220201 A1 * 10/2005 Laroia et al. ..... 375/260
2005/0276335 A1 * 12/2005 Kumar ..... 375/260
2007/0002961 A1 * 1/2007 Hoctor et al. ..... 375/267
2007/0050835 A1 * 3/2007 Liva et al. ..... 725/129
2007/0202813 A1 * 8/2007 Ono et al. ..... 455/78
2007/0202814 A1 * 8/2007 Ono et al. ..... 455/78
2007/0211786 A1 * 9/2007 Shattil ..... 375/141
2008/0178227 A1 * 7/2008 Petrovic et al. ..... 725/68
2009/0110033 A1 * 4/2009 Shattil ..... 375/141

* cited by examiner

SIGNAL DISTRIBUTION SYSTEM EMPLOYING A MULTI-STAGE SIGNAL COMBINER NETWORK

CROSS REFERENCE TO RELATED APPLICATIONS

This application claims the benefit of U.S. provisional application 60/805,134 entitled "Multi-Stage Signal Combiner Network," filed Jun. 19, 2006, the contents of which are incorporated herein by reference in its entirety for all purposes.

BACKGROUND

The present invention relates to signal distribution systems and to signal combiner networks employed therein.

FIG. 1A illustrates a conventional signal distribution system useful for processing satellite signals as known in the art. The system 100 employs antennas 110, 112, each operable to collect transponder signals 102*a,b* and 102*c,d* which may be grouped within a common IF-band signal (e.g., L-band). The transponder signals 102 may be communicated at various frequencies (e.g., Ku or Ka-bands) and at different polarizations (e.g., 102*a,b* at horizontal and vertical, and 102*c,d* at left-hand and right-hand circular polarizations). The system further includes an outdoor unit 120 (ODU), which may be in the form of a low noise block (LNB). The ODU 120 includes a downconverter switch 122 operable to downconvert a band of channels/transponders of a received signal 102*a*-102*d* to an IF frequency (e.g., L-band) and to switchably couple the downconverted band of channels to any one or more of the cables $\mathbf{130}_1$-$\mathbf{130}_n$ for distribution to corresponding set-top boxes (STB) $\mathbf{140}_1$-$\mathbf{140}_n$. Each set top box 140 includes a tuner 142 for tuning to a particular channel/transponder of a particular satellite signal 102*a*-120*d*. When the tuner $\mathbf{142}_1$ is controlled to receive a desired channel, the ODU 120 is configured to receive the desired satellite signal and downconverts an entire band of channels to an IF frequency, placing said band of channels on the cable $\mathbf{130}_1$ for transmission to the tuner $\mathbf{142}_1$. The tuner $\mathbf{142}_1$ then selects the desired channel from the band of channels present on the cable $\mathbf{130}_1$. Because the band downconverter switch 122 operates to supply a band of channels to each cable $\mathbf{130}_1$-$\mathbf{130}_n$, each tuner $\mathbf{140}_1$-$\mathbf{140}_n$ receives a group of channels along its respective cable $\mathbf{130}_1$-$\mathbf{130}_n$ in order to select the particular channel the tuner wishes to receive.

FIG. 1B illustrates a signal distribution system implementing a channel stacking switch known in the art. In this system, a channel stacking switch 160 is implemented to permit multiple tuners $\mathbf{140}_1$-$\mathbf{140}_n$ to access a desired transponder/channel with a single cable 130. The channel stacking switch 160 resides in the ODU 170, the channel stacking switch 160 having multiple inputs, each input operable to receive a band of channels supplied by the downconverter switch 122. When, for example, tuner $\mathbf{142}_1$ in the set-top box $\mathbf{140}_1$ is controlled to receive a particular channel, downconverter switch 122 is controlled to provide a band of channels to output 122*a*, the supplied band of channels including the desired channel. This downconverted band of channels is supplied to the input 160*a* of the channel stacking switch 160, which frequency translates the downconverted band of channels, such that the desired channel is frequency translated to frequency $f_1$ (e.g., using mixer $\mathbf{162}_1$ to translate the desired channel to frequency $f_1$), frequency $f_1$ being previously assigned to the requesting tuner $\mathbf{142}_1$. The frequency-translated band of channels is applied to a filter $\mathbf{163}_1$, whereby the desired channel is frequency aligned to the passband portion of the filter 163 to pass the desired channel and to remove the unselected channels of the band of channels. Signal combiner 168 operates to combine each of the filtered signals, thereby forming a frequency-multiplexed signal output onto cable 130. Each tuner $\mathbf{140}_1$-$\mathbf{140}_n$ is configured to tune to a particular frequency of the frequency-multiplexed signal, and in this manner, each of the n different tuners can simultaneously receive its signal from the single cable 130.

FIG. 1C illustrates a signal combiner network implemented in the channel stacking switch 160 known in the prior art. As previously described, filters 163 operate to remove unwanted portions of the signal spectrum that are supplied to a signal combiner 168. Additionally, variable gain amplifiers 164 may be implemented to provide a signal leveling function, whereby each of the filtered signals supplied to the signal combiner 168 are substantially the same amplitude.

While the aforementioned system is generally effective in providing a means for supplying multiple transponders/channels along a single cable to multiple output devices/tuners, some drawbacks are present. In particular, insertion loss of the signal combiner 168 can be high, especially for combiners having a large number of input ports. To overcome this loss, higher gain of amplifiers 164 and/or additional amplifiers may be required. This comes at the cost of possibly higher spurious products (and power consumption generated thereby), because each amplifier generates broadband noise at the output (and possibly distortion terms), falling on and adversely affecting other channels after combining in 168, thus reducing the efficacy of the filtering performed in the preceding stages 163.

Therefore there is room in the art for improvement of the system performance by reducing the adverse effect of the broadband amplifier noise, addressed hereinafter by the present invention.

SUMMARY

The present invention provides a multi-stage signal combining network implementable with a channel stacking switch system or any signal distribution system in which improved signal isolation is achieved. In one embodiment, the multi-stage signal combining network includes two or more first stage combiner circuits, two or more filters, and at least one second stage signal combiner circuit. Each of the first stage combiner circuits has two or more input ports coupled to receive a respective two or more signals, and a first combiner output port. Each of the two or more filters includes an input coupled to one first stage combiner output port and a filter output port. The at least one second stage combiner circuit includes two or more input ports, each coupled to one filter output port, and a second stage combiner output port.

These and other features of the invention will be better understood in view of the following drawings and description of exemplary embodiments

For clarity, features identified in previous drawings retain their reference indicia in subsequent drawings.

DETAILED DESCRIPTION OF EXEMPLARY EMBODIMENTS

Figure 1A:
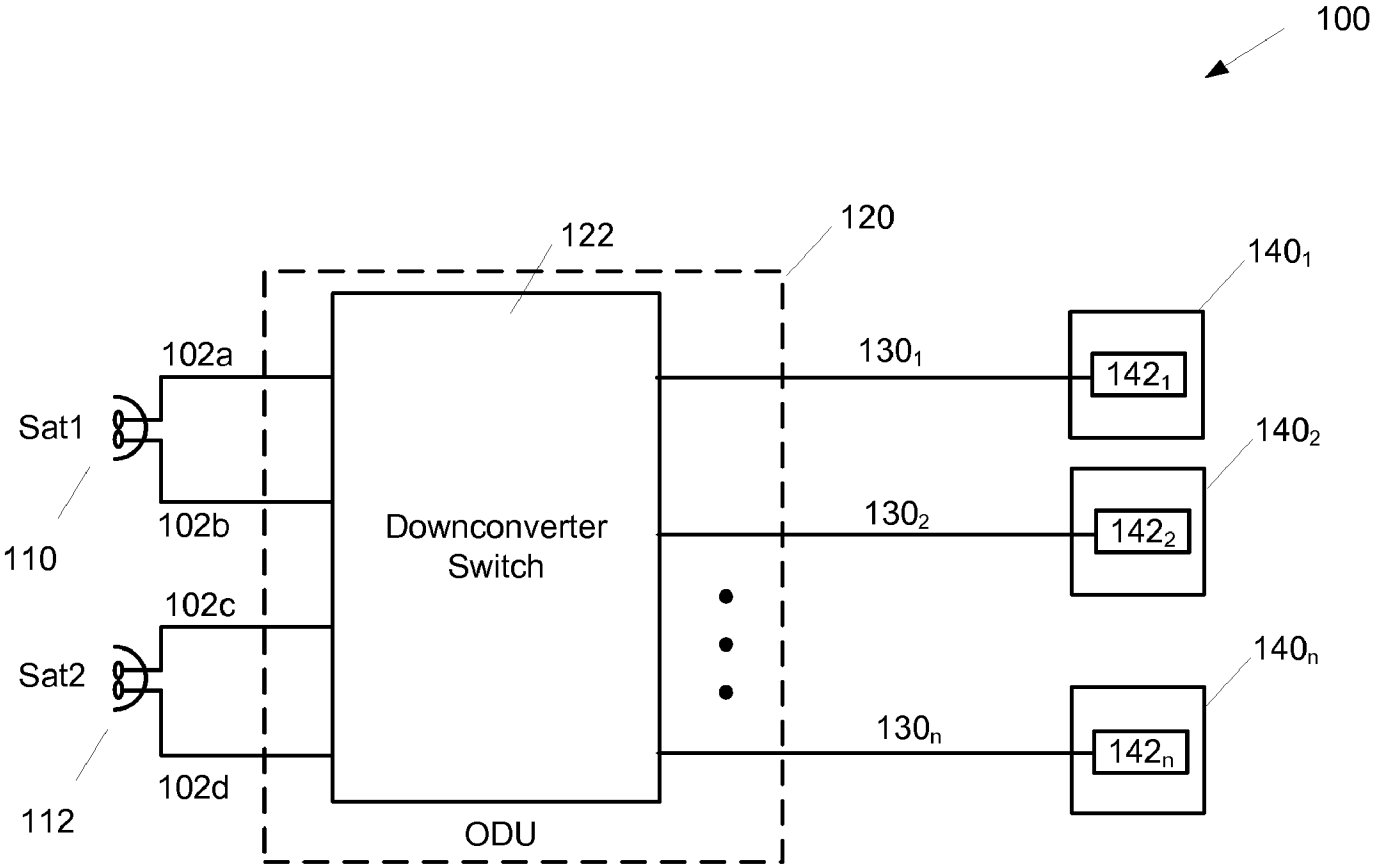
Fig. 1A Prior Art
FIG. 1A illustrates a conventional direct broadcast satellite (DBS) system known in the art.
Figure 1B:
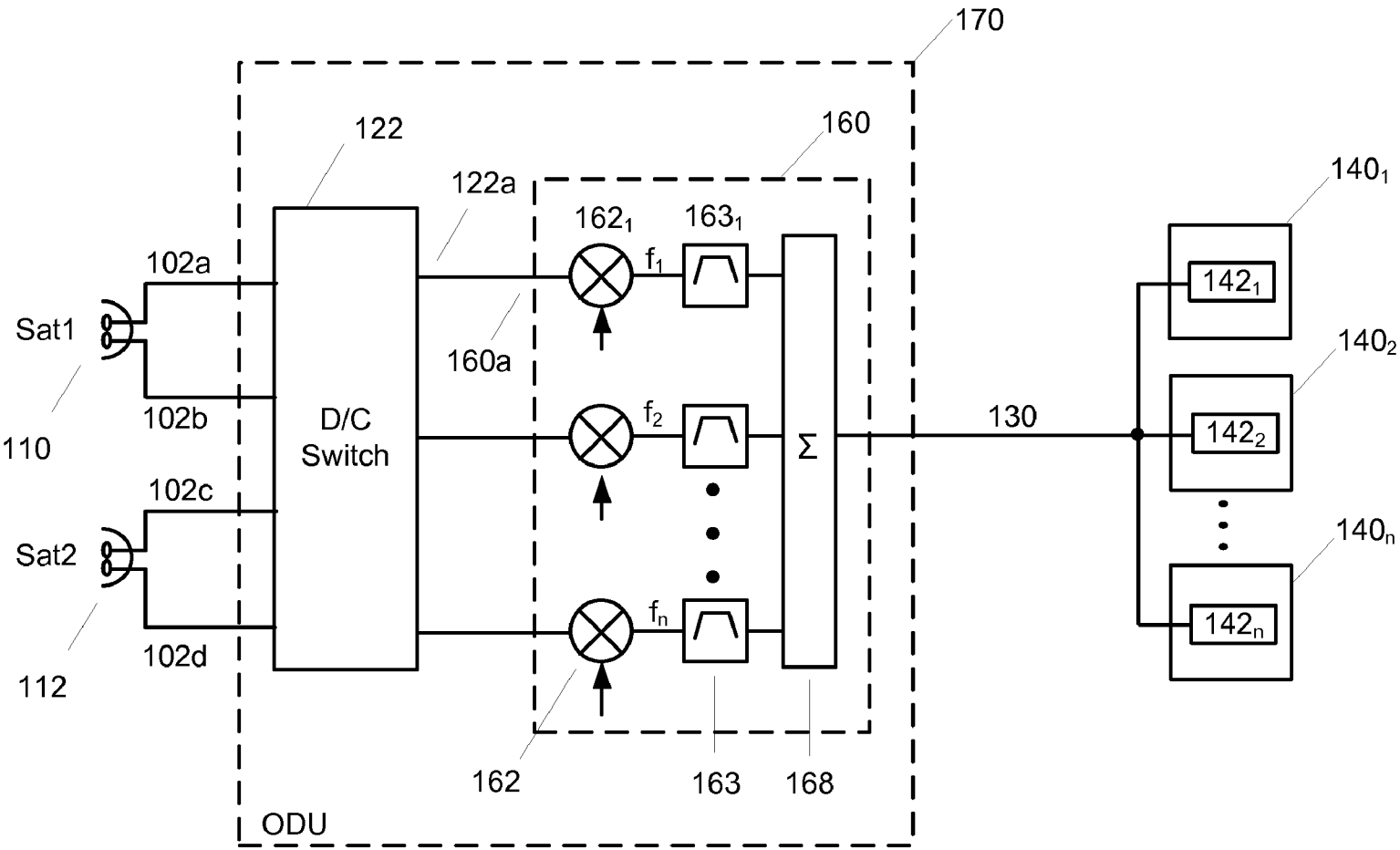
Fig. 1B Prior Art
FIG. 1B illustrates a signal distribution system implementing a channel stacking switch known in the art.
Figure 1C:
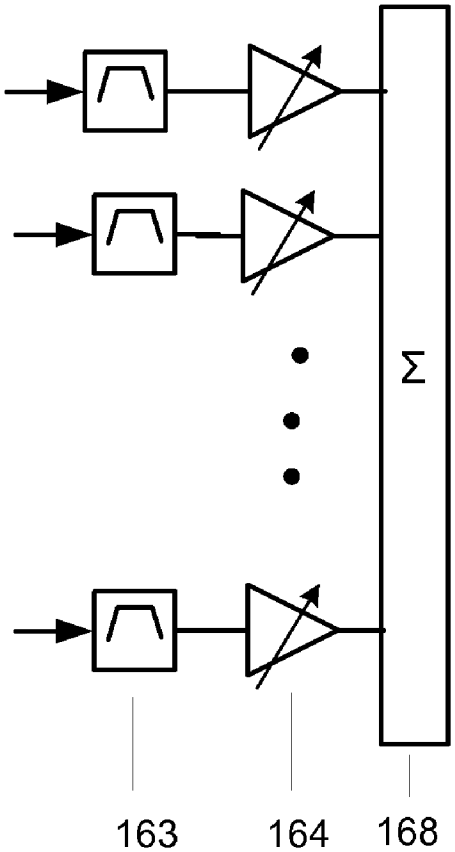
Fig. 1C Prior Art
FIG. 1C illustrates a signal combiner network implemented in the channel stacking switch known in the prior art.
Figure 2:
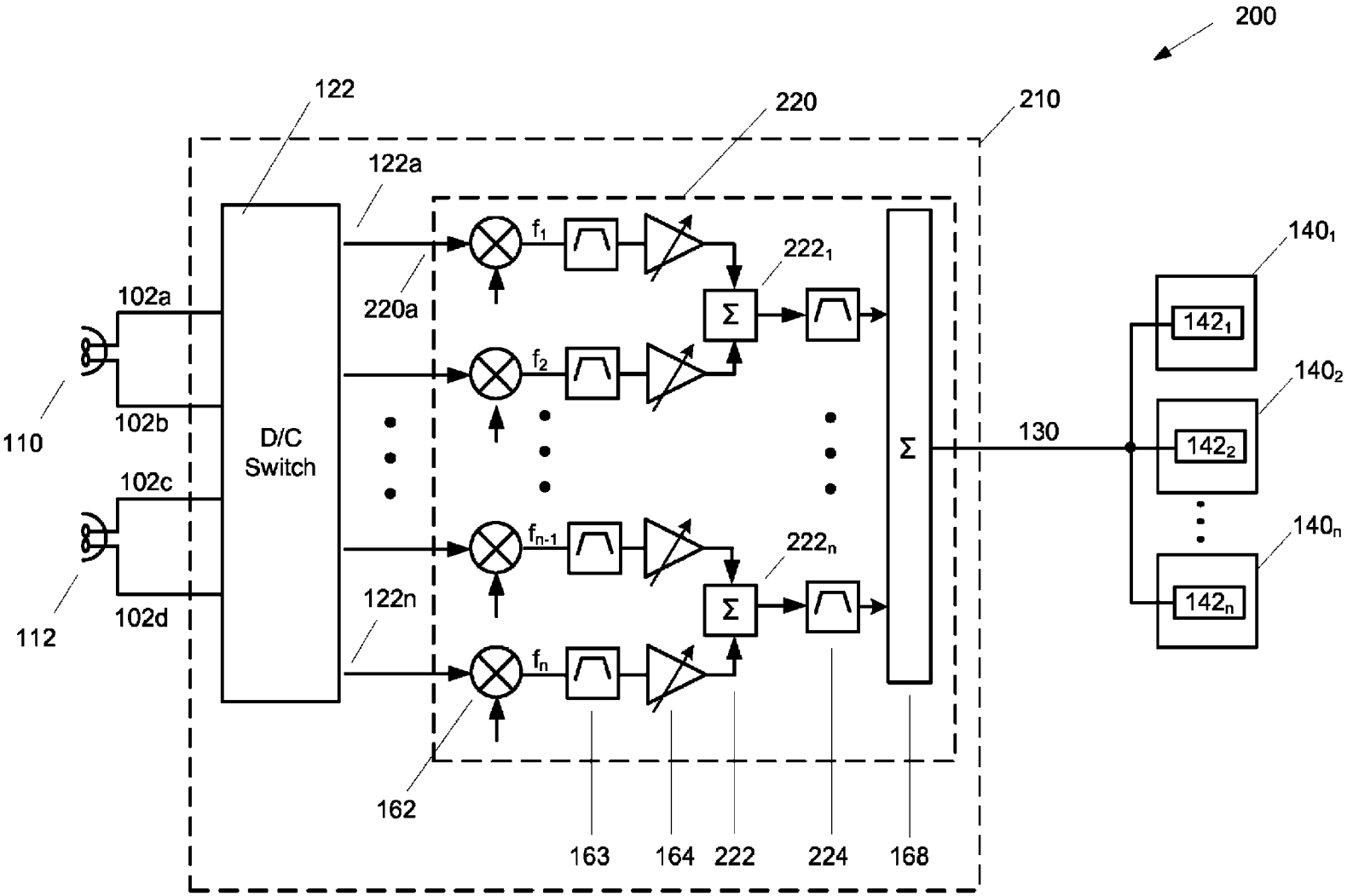
FIG. 2 illustrates an exemplary channel stacking signal distribution system implementing a multi-stage signal combiner network in accordance with the present invention.

FIG. 2 illustrates an exemplary channel stacking signal distribution system 200 implementing a multi-stage signal combiner network in accordance with the present invention. The system includes the aforementioned components of one or more antennae 110, 112 and a downconverter switch 122. In addition, a channel stacking switch 220 is implemented to permit multiple receivers $\mathbf{140}_1$-$\mathbf{140}_n$ to access a desired transponder/channel with a single cable 130. In the illustrated embodiment, the channel stacking switch 220 resides in the ODU 210 with the downconverter switch 122, although in other embodiments, the channel stacking switch 220 may be located separately therefrom.

The system 200 includes the previously-described components, as well as an ODU 210 employing the aforementioned downconverter switch 122 and a channel stacking switch 220. The new channel stacking switch 220 includes the aforementioned mixers 162, filters 163, variable gain amplifiers 164, and signal combiner 168, and new components, including signal combiners 222 and filters 224. In the illustrated embodiment, signal combiners 222 precede the signal combiner 168, and accordingly signal combiners 222 are referred to as "previous stage" or "first stage" signal combiners, and the signal combiner 168 is referred to as a "subsequent stage," or "second stage" signal combiner. Similarly, filters 163 are referred as "previous stage" or "first stage" filters, and filters 224 are referred to as "subsequent stage" or "second stage" filters. In a particular embodiment, the second stage combiner forms the last stage combiner, in which case the frequency-division multiplexed signal output therefrom represents the signal which is supplied to each of the receivers 140.

Multiple signal combining stages with filtering in-between (such as 224) operate to improve signal-to-signal isolation of the system, i.e. reduce the out-of-band energy of a sub-group of channels leaking into and falling onto other channels or sub-groups of channels. Furthermore, the improved signal isolation comes without implementing additional amplifiers, which would contribute to the generation of greater spurious products and higher power consumption. While two signal combining stages are shown in the exemplary embodiments, the skilled person will appreciate that an additional number of signal combining stages may also be implemented in an alternative embodiment. For example, 3, 4, 5, 6, 8, 10, 12, 16, 18, 20, 50, or more signal combining stages may be used. Preferably, subsequent stages of signal combiners implement successively fewer signal combiners per stage.

In the illustrated embodiment, each of the first stage combiners 222 includes two inputs and one output, each input coupled to receive a respective one of the frequency-translated signals $f_1$-$f_n$. Alternatively, the first stage signal combiners 222 may include 3 or more inputs, each signal combiner 222 operable to combine its received signals into a frequency-division multiplexed composite signal. First and second stage signal combiners 222 and 168 may be implemented using a variety of structures, e.g., as a current summing network, a voltage summing network, as a distributed structure, such as a wilkinson power divider, or similar structures operable to combine two applied signals.

The system 200 additional includes variable gain amplifiers 164 for providing a signal leveling function, whereby the gain/attenuation level of each amplifier is set such that all of the signals supplied to the signal combiners 222 are at substantially the same amplitude. Alternatively or in addition, variable gain amplifiers may be located at different positions along the signal path, e.g., ahead of the signal combiner 168.

The system 200 further includes optional second (or subsequent) stage filters 224 for providing additional out-of-channel rejection and signal-to-signal isolation as needed. Similar to the first stage filters 163, the second stage filters may employ a bandpass, lowpass, highpass of band stop response implemented in any of a variety of designs, including butterworth, chebychev, elliptical, or other designs. Furthermore, filters 163 and 224 may have a fixed or variable frequency characteristic, whereby the filter's center frequency, 3 dB bandwidth, cut-off frequency, or bandstop frequency is controllably variable. While second stage filters 224 are illustrated for each of the signal paths, they may be omitted from one, some, or all of the signal paths if additional signal filtering or isolation is not required. In an alternative embodiment of the invention, primary filtering of the band of channels may be performed by filters 224 coupled between the first and second stage combiners 222 and 168. In such an embodiment, filters 163 may be optionally employed to provide additional signal rejection and signal-to-signal isolation. Furthermore, filters 163 and/or 224 may be incorporated within their respective signal combining structures 222 and 168.

Several filtering arrangements may be implemented to provide the desired channel as an input to the last stage combiner 168 when two or more filter stages are implemented. Along each signal path (e.g., extending from output of mixer $\mathbf{162}_1$ to the input of second signal combiner 168), the first (or previous) stage filter may be a low pass filter operating to attenuate all frequency-translated channels above the desired frequency-translated channel (e.g., 3 dB cutoff at $f_1$), and the second (or subsequent) stage filter may be a high pass filter operable to attenuate all channels below the desired channel (e.g., 3 dB cutoff at $f_1$). In another embodiment, the first and second stage filters are bandpass filters each centered to allow the desired frequency-translated channel to pass therethrough (e.g., centered at $f_1$), with successive filters having successively narrow passbands, such that the final filter passes only the desired channel therethrough. Still further alternatively, one or more bandstop filters may be employed, each operable to reject a corresponding frequency-translated channel to provide the desired channel to the input of the last stage signal combiner 168 (e.g., filters 163 and 224 providing notches at adjacent channels, respectively). In another embodiment, rejection of all channels within the frequency-translated band of channels may not be required, as tuners $\mathbf{140}_1$-$\mathbf{140}_n$ may provide some degree of rejection of the unwanted channels, especially non-adjacent channels. In such an embodiment, filters 163 and/or 224 provide rejection of particular channels only (e.g., adjacently-located channels), and do not reject all of the non-desired channels.

Figure 3:
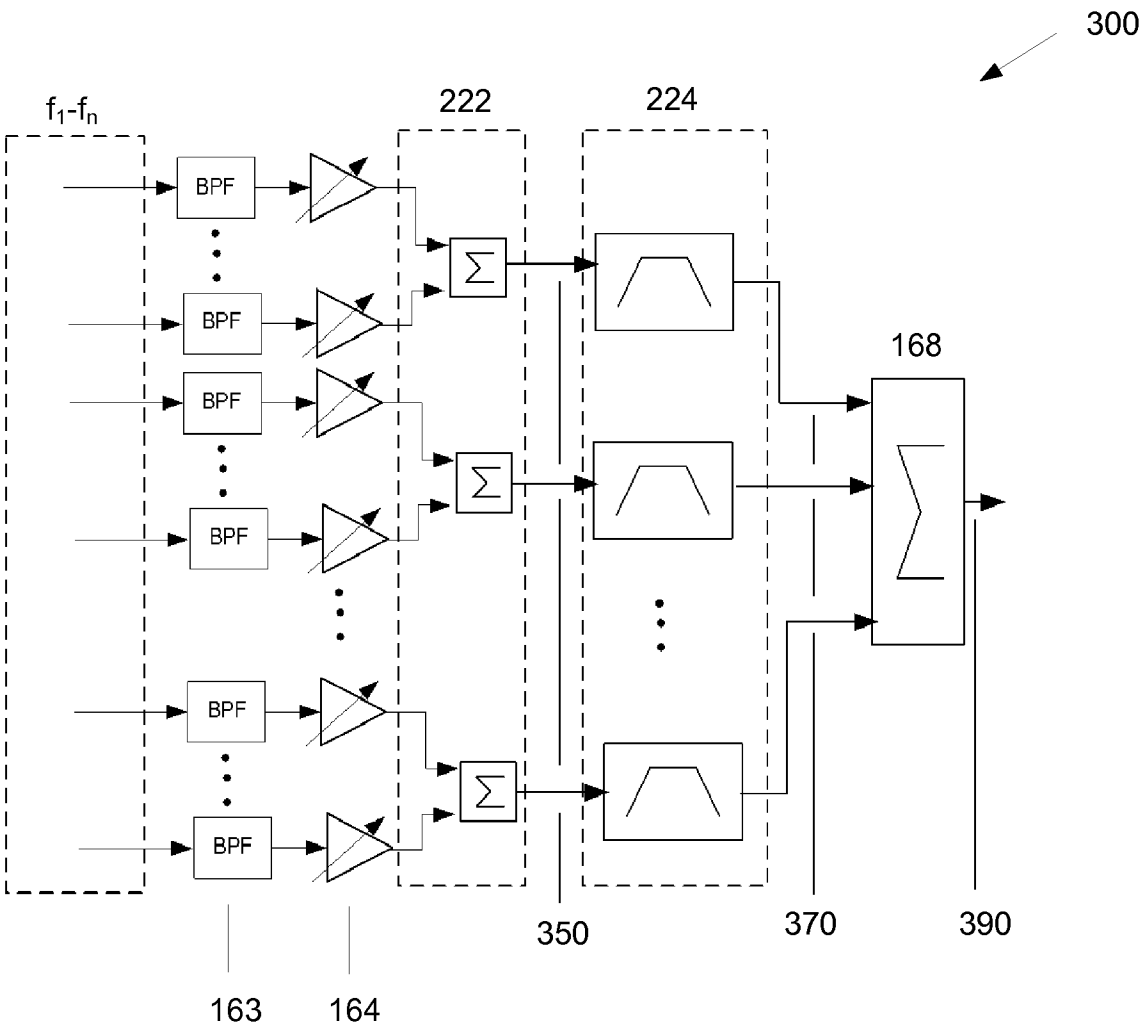
FIG. 3 illustrates a detailed block diagram of an exemplary multi-stage signal combiner network in accordance with the present invention.

FIG. 3 illustrates an exemplary embodiment of a multi-stage signal combiner network 300 implemented in the channel stacking signal distribution system of FIG. 2 in accordance with the present invention. Signals $f_1$-$f_n$ are applied to first stage filters 163 and variable gain amplifiers 164, and subsequently summed using a group of first stage signal (i.e., voltage/current/power) combiners 222. The first stage signal combiners 222 may be active or passive circuits, and be realized in either a monolithic circuit or in hybrid form, such as on a printed circuit board. While only two inputs are shown for each combiner 222, three or more inputs may be used in alternative embodiments.

The combined signals 350 are subsequently filtered by means of second stage filters 224 to reduce noise and spurious out-of-band to this group but within the band of other groups. In the illustrated embodiment, bandpass filters are used for the second stage filters 224, although other filter types, such as lowpass, highpass, or bandstop filters may be used in alternative embodiments. Various filter architectures may be used, for example, chebychev, butterworth, elliptical filters, and the like in either fixed or tunable configurations, as noted above.

A second stage combiner 168 is used to sum the filtered signals 370 to provide a frequency-division multiplexed output signal 390. The second stage signal (voltage/current/power) combiner 168 may be active or passive, and realized in monolithic or hybrid form. This multiple-stage approach to signal combining improves the over-all signal-to-noise ratio (SNR) for the system and minimizes cost by reducing the number of bandpass filters needed.

The skilled artisan will appreciate that additional filtering and signal combining stages may be used. For example, a total of 3, 4, 5, or more filtering and signal combining stages may be used to provide a frequency-division multiplexed output signal 390. In such an instance in which three or more total combining stages are used, two or more second stage combiners 168 will be used. It is further noted that the illustrated network of FIG. 3 can be realized in a variety of circuits, e.g., as a discrete circuit, a hybrid circuit in which a portion of the network is realized as an off IC chip component, or completely monolithically within one or more IC chips. In a particular embodiment, the first stage combiners 222 are 3 input voltage summing nodes implemented within an integrated circuit, second stage filters 224 are printed circuit board-based 0.5 dB ripple, $3^{rd}$ order Chebychev 300 MHz bandwidth bandpass filters employing discrete capacitors, and the second stage combiner 168 is a 3-input printed circuit board-based Wilkinson-type combiner. The present embodiment envisions operation within the satellite television band, although the invention can be employed in any radio frequency application.

In general, the multi-stage signal combiner network 300 is operable to produce a frequency-division multiplexed output signal 390 from a plurality of signals $f_1$-$f_n$ comprising bands of channels. The multi-stage signal combiner network 300 includes a plurality of filters (e.g., first stage filters 163, second stage filters 224, or a combination thereof), a plurality of first stage signal combiner circuit 222, and a second stage signal combiner 168. One or more of the plurality of filters 163, 224 includes an input coupled to receive a band of channels and an output, each filter including a predefined passband (or stopband if a bandstop filter is implemented) operable to pass a selected one or more channels of said band of channels, and to reject an unselected one or more channels of said band of channels. In one exemplary embodiment, first stage filters 163, second stage filters 224, or a combination thereof operate to pass only a selected (frequency-translated) channel and reject all other channels included within the received (frequency-translated) band of channels. In other embodiments, first stage filters 163 and/or second stage filters 224 operate to pass the selected channel and at least one non-selected channel, when, e.g., the tuner is operable to reject the non-selected channel(s).

Further exemplary as shown, each of the first stage combiner circuits 222 includes plurality of input ports and a first combiner output port. The second stage combiner circuit 168 includes two or more input ports and an output port for providing the frequency-division multiplexed output signal. Each of the second combiner input ports are coupled to an output of a respective one of the first stage combiners.

Filtering to remove one or more non-selected (frequency-translated) channels within each of the received (frequency-translated) band of channels may be performed by filters 163, filters 224, or a combination of both. When filters 163 are implemented for this operation, each filter 163 includes an input coupled to receive a respective one of the band of channels, and an output coupled to an input of a respective one of the plurality of first stage combiners 222. When filters 224 are implemented for this operation, each filter 224 includes an input coupled to an output of a respective one of the first stage signal combiners 222, and an output coupled to an input of the second stage signal combiners 168. Both filters may be implemented as well. Additionally, the aforementioned mixers 162 and amplifiers 164 may be assembled therewith (in integrated or discrete form) to construct a channel stacking switch 220, a downconverter switch 122 assembled therewith to form an outdoor unit 210, and antennae 110, 112, cable 130, and receivers 140 assembled therewith to form a signal distribution system.

Figure 4:
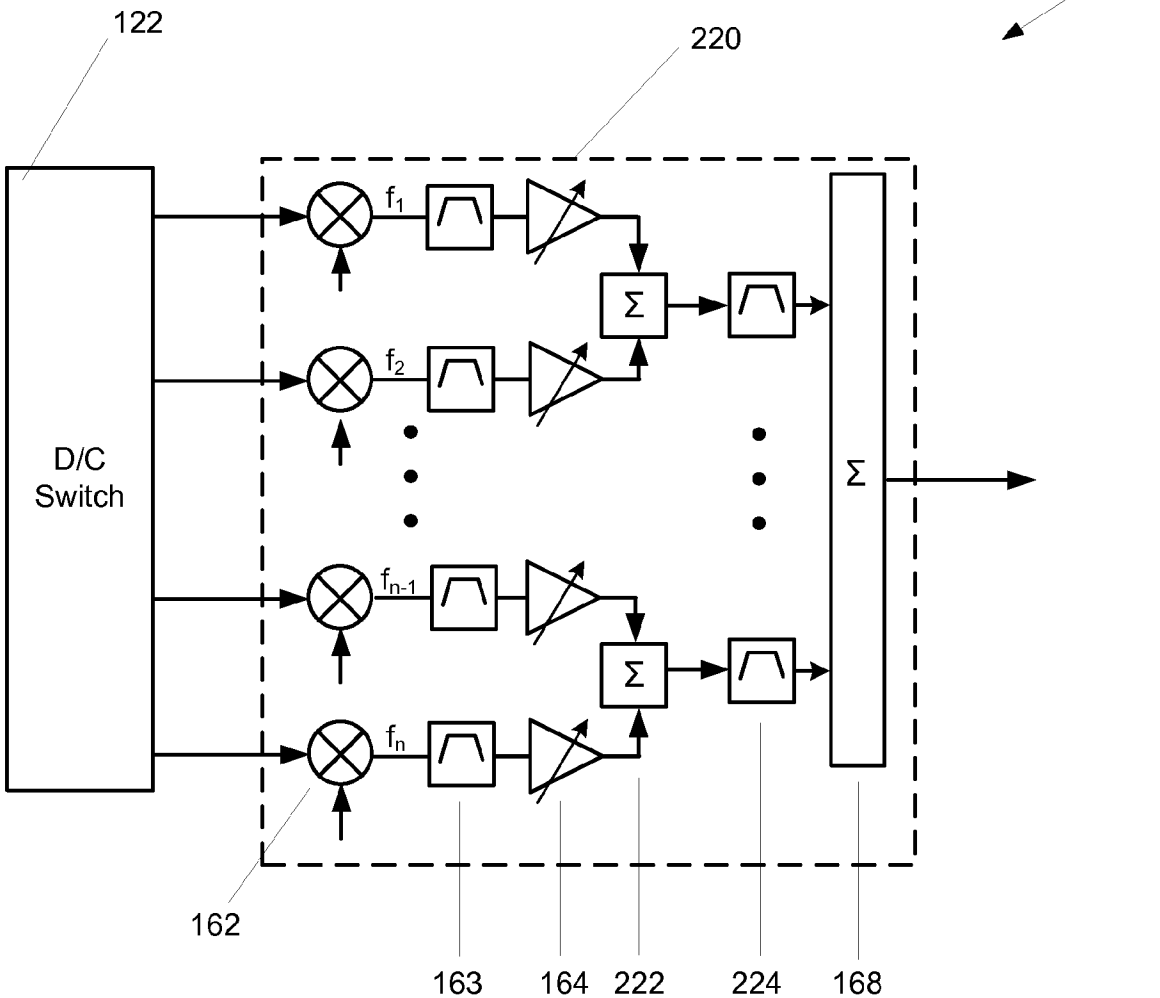
FIG. 4 illustrates a detailed block diagram of an exemplary outdoor unit implementing a multi-stage signal combiner network in accordance with the present invention.

FIG. 4 illustrates a detailed block diagram of an exemplary outdoor unit 210 implementing in accordance with the present invention, with previously identified features retaining their reference numbers. The outdoor unit 210 includes a downconverter switch 210 and the above-described channel stacking switch 220. The downconverter switch 210 is coupled to receive each of the received signals 102*a*-102*d*, the downconverter switch 210 operable to switchably output on any one or more of its output terminals, a downconverted band of channels corresponding to any of the received signals 102*a*-102*d*. The downconverted band of channels is then supplied to the channel stacking switch 220 which operates to construct a frequency-division multiplexed composite signal, as described above.

Figure 5:
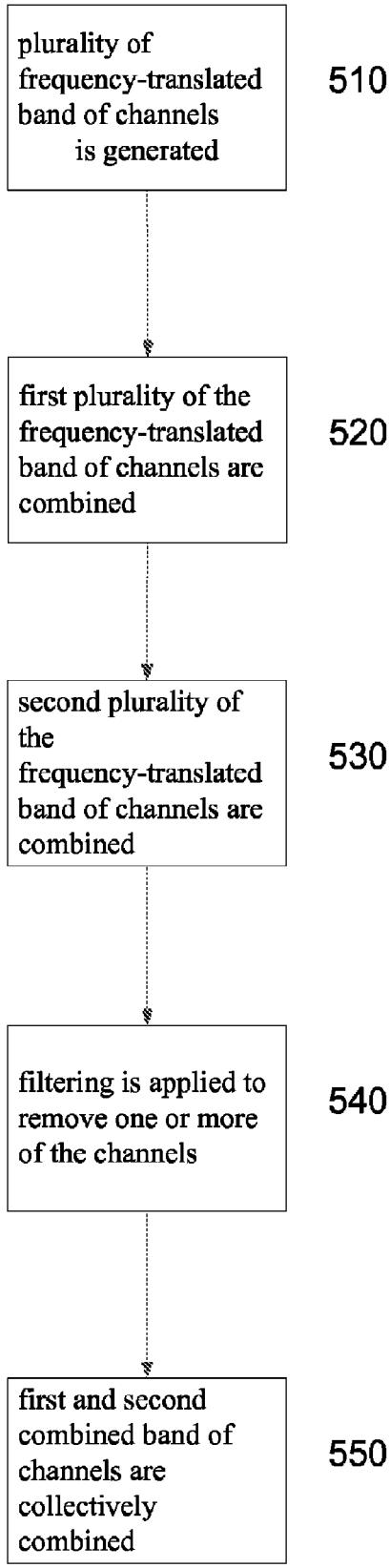
FIG. 5 illustrates a method for generating a frequency-division multiplexed composite signal using a multi-stage signal combiner network in accordance with the present invention.

FIG. 5 illustrates a method for generating a frequency-division multiplexed composite signal using a multi-stage signal combiner network in accordance with the present invention. At operation, 510, a plurality of frequency-translated band of channels is generated. In the exemplary embodiment of FIG. 2, a downconverter switch 112 and mixers 162 are implemented to provide a plurality of "n" frequency-translated band of channels, "n" numbering, for example, 2, 3, 4, 5, 6, 8, 10, 20, 50 or more bands of channels.

At 520, a first plurality of the frequency-translated band of channels are combined to form a first combined band of channels, and at 530 a second plurality of the frequency-translated band of channels are combined to form a second combined band of channels. In the exemplary embodiment of FIG. 2, frequency-translated bands of channels $f_1$ and $f_2$ are combined using a first stage combiner $\mathbf{222}_1$, and frequency-translated band of channels at $f_{1-1}$ and $f_n$ are combined using first stage combiner $\mathbf{222}_n$.

At 540, filtering is applied to remove one or more of the channels within one or more of the first and second combined band of channels. While the filtering operation is illustrated as being subsequent to the combining operation 520, no particular sequence of operations 510-550 is required or intended. For example in one embodiment, the filtering operation of 530 may be applied prior to the first stage combining operations 520/530, using the first stage filters 163. In another embodiment, the filtering operations 530 may be applied after the first stage combining operations 520/530 using the second stage filters 224. In still a further embodiment, filtering is applied both before and after the first stage combining operations 520/530 using both the first and second stage filters 163 and 224.

At 550, the first and second combined band of channels are collectively (or second-stage) combined to form a frequency-division multiplexed signal which excludes one or more of the channels initially received. In the exemplary embodiment of FIG. 2, this operation is implemented by the second signal combiner circuit 168. As noted above, additional signal combining stages may be implemented, e.g., a total of 3, 4, 5, 6, 8, 10, 12, 16, 18, 20, 50, or more signal combining stages. In embodiments in which additional signal combining stages are employed, at least one second-stage combining operation will be introduced, as well as at least one third/subsequent-stage combining operation. In such an embodiment, the outputs of the second-stage combining operations are third-stage combined to form the frequency-division multiplexed composite signal. Furthermore in such an embodiment, the aforementioned filtering operation may be applied either before the first-stage combining operations 520 and/or 530, between first-stage and second-stage combining operations (after 520/530 and before 540), after the second-stage combining operation 540, or any combination thereof. Those skilled in the art will appreciate that with additional combining operations, other possibilities exist as where filtering may be applied.

As readily appreciated by those skilled in the art, the described processes may be implemented in hardware, software, firmware or a combination of these implementations as appropriate. In addition, some or all of the described processes may be implemented as computer readable instruction code resident on a computer readable medium, the instruction code operable to program a computer of other such programmable device to carry out the intended functions. The computer readable medium on which the instruction code resides may take various forms, for example, a removable disk, volatile or non-volatile memory, etc., or a carrier signal which has been impressed with a modulating signal, the modulating signal corresponding to instructions for carrying out the described operations.

The terms "a" or "an" are used to refer to one, or more than one feature described thereby. Furthermore, the term "coupled" or "connected" refers to features which are in communication with each other (electrically, mechanically, thermally, as the case may be), either directly, or via one or more intervening structures or substances. The sequence of operations and actions referred to in method flowcharts are exemplary, and the operations and actions may be conducted in a different sequence, as well as two or more of the operations and actions conducted concurrently. All publications, patents, and other documents referred to herein are incorporated by reference in their entirety. To the extent of any inconsistent usage between any such incorporated document and this document, usage in this document shall control.

The foregoing exemplary embodiments of the invention have been described in sufficient detail to enable one skilled in the art to practice the invention, and it is to be understood that the embodiments may be combined. The described embodiments were chosen in order to best explain the principles of the invention and its practical application to thereby enable others skilled in the art to best utilize the invention in various embodiments and with various modifications as are suited to the particular use contemplated. It is intended that the scope of the invention be defined solely by the claims appended hereto.

What is claimed is:

1. A multi-stage signal combiner network, comprising:

a plurality of first stage combiner circuits, each first stage combiner circuit having a plurality of input ports coupled to at least one antenna to receive a band of channels and having a first stage combiner output port;

a plurality of filters, each filter having an input coupled to one first stage combiner output port and a filter output port;

a second stage combiner circuit, the second stage combiner circuit having a plurality of input ports and an output port, each of the second stage combiner circuit input ports coupled to an output of a respective one of the plurality of filters; and a plurality of variable gain amplifiers, each variable gain amplifier having an input and an output, each variable gain amplifier output coupled to an input of a respective one of the plurality of first stage combiner circuits.

2. A system, comprising:

a plurality of mixers, each mixer including an input coupled to receive a band of channels, and an output for providing a frequency-translated version of said received band of channels;

a plurality of first stage combiner circuits, each first stage combiner circuit having a plurality of input ports and an output port, each first stage combiner circuit input port coupled to the output of a respective one of the plurality of mixers;

a plurality of filters, each filter having an input coupled to one first stage combiner output port and a filter output port;

a second stage combiner circuit, the second stage combiner circuit having a plurality of input ports and an output port, each of the second stage combiner circuit input ports coupled to an output of a respective one of the plurality of filters; and a plurality of variable gain amplifiers, each variable gain amplifier having an input and an output, each variable gain amplifier output coupled to an input of a respective one of the plurality of first stage combiner circuits.

3. The system of claim 2, wherein each of said first and second stage combiner circuits are selected from the group consisting of a wilkinson power combiner, a voltage summing network, or a current summing network.

4. The system of claim 2, wherein each of the filters are selected from the group consisting of a bandpass filter, a lowpass filter, a highpass filter, or a bandstop filter.

5. The system of claim 2, further comprising a plurality of first stage filters, each first stage filter having an input and an output, each first stage filter input coupled to an output of a respective one of the plurality of mixers, and each first stage filter output coupled to an input of a respective one of the plurality of first stage combiner circuits.

6. The system of claim 2, further comprising a plurality of variable gain amplifiers, each variable gain amplifier having an input and an output, each variable gain amplifier input coupled to an output of a respective one of the plurality of first stage filters, and each variable gain amplifier output coupled to an input of a respective one of the plurality of first stage combiner circuits.

7. A system, comprising:

a downconverter switch for providing a plurality of downconverted band of channels;

a plurality of mixers, each mixer including an input coupled to receive a respective one of the plurality of downconverted band of channels, and an output for providing a frequency-translated version of said downconverted band of channels;

a plurality of first stage combiner circuits, each first stage combiner circuit having a plurality of input ports and an output port, each first stage combiner circuit input port coupled to the output of a respective one of the plurality of mixers;

a plurality of filters, each filter having an input coupled to one first stage combiner output port and a filter output port;

a second stage combiner circuit, the second stage combiner circuit having a plurality of input ports and an output port, each of the second stage combiner circuit input ports coupled to an output of a respective one of the plurality of filters; and a plurality of variable gain amplifiers, each variable gain amplifier having an input and an output, each variable gain amplifier output coupled to an input of a respective one of the plurality of first stage combiner circuits.

8. The system of claim 7, wherein each of said first and second stage combiner circuits are selected from the group consisting of a wilkinson power combiner, a voltage summing network, or a current summing network.

9. The system of claim 7, wherein each of the filters are selected from the group consisting of a bandpass filter, a lowpass filter, a highpass filter, or a bandstop filter.

10. The system of claim 7, further comprising a plurality of first stage filters, each first stage filter having an input and an output, each first stage filter output coupled to an input of a respective one of the plurality of first stage combiner circuits.

11. The system of claim 7, further comprising a plurality of variable gain amplifiers, each variable gain amplifier having an input and an output, each variable gain amplifier output coupled to an input of a respective one of the plurality of first stage combiner circuits.

12. A signal distribution system, comprising:

one or more antennas for outputting a collective plurality of received signals;

a downconverter switch coupled to receive the collective plurality of signals, and operable to provide a plurality of downconverted band of channels corresponding thereto;

a plurality of mixers, each mixer including an input coupled to receive a respective one of the plurality of downconverted band of channels, and an output for providing a frequency-translated version of said downconverted band of channels;

a plurality of first stage combiner circuits, each first stage combiner circuit having a plurality of input ports and an output port, each first stage combiner circuit input port coupled to the output of a respective one of the plurality of mixers;

a plurality of filters, each filter having an input coupled to one first stage combiner output port and a filter output port; and a second stage combiner circuit, the second stage combiner circuit having a plurality of input ports and an output port, each of the second stage combiner circuit input ports coupled to an output of a respective one of the plurality of filters a plurality of variable gain amplifiers, each variable gain amplifier having an input and an output, each variable gain amplifier output coupled to an input of a respective one of the plurality of first stage combiner circuits.

13. The system of claim 12, wherein each of said first and second stage combiner circuits are selected from the group consisting of a wilkinson power combiner, a voltage summing network, or a current summing network.

14. The signal distribution circuit of claim 12, wherein each of the filters are selected from the group consisting of a bandpass filter, a lowpass filter, a highpass filter, or a bandstop filter.

15. The signal distribution system of claim 12, further comprising a plurality of first stage filters, each first stage filter having an input and an output, each first stage filter output coupled to an input of a respective one of the plurality of first stage combiner circuits.

16. A multi-stage signal combiner network operable to produce a frequency-division multiplexed output signal from a plurality of signals comprising bands of channels, the multi-stage signal combiner network comprising:

a plurality of filters, each filter having an input coupled to receive a band of channels and an output, each filter including a predefined passband operable to pass a selected one or more channels of said band of channels, and to reject an unselected one or more channels of said band of channels;

a plurality of first stage combiner circuits coupled to the plurality of filters, each first stage combiner circuit having a plurality of input ports and a first combiner output port;

a second stage combiner circuit, the second stage combiner circuit having a plurality of input ports and an output port for providing the frequency-division multiplexed output signal, each input port coupled to an output of a respective one of the plurality of first stage combiners; and a plurality of variable gain amplifiers, each variable gain amplifier having an input and an output, each variable gain amplifier output coupled to an input of a respective one of the plurality of first stage combiner circuits.

17. The multi-stage signal combiner network of claim 16, wherein each of said plurality of filters includes an input coupled to an output of a respective one of the mixers, and an output coupled to an input of a respective one of the plurality of first stage signal combiners.

18. The multi-stage signal combiner network of claim 16, wherein each of said plurality of filters includes an input coupled to an output of a respective one of the first stage signal combiners, and an output coupled to an input of the second stage signal combiners.

19. A method for generating a frequency-division multiplexed composite signal, the method comprising:

generating a plurality of frequency-translated bands of channels;

combining, in a first stage of combiners, at least one of the plurality of frequency-translated bands of channels to form a first combined band of channels;

combining, in the first stage of combiners, a second plurality of the frequency-translated bands of channels to form a second combined band of channels;

applying filtering to at least one of the first and second combined bands of channels to remove one or more channels therefrom;

combining, in a subsequent stage of combiners, the first and second band of channels whereby at least one of the first and second combined band of channels has been filtered, the combining in the subsequent stage of combiners producing a frequency-division multiplexed composite signal, the frequency-division multiplexed composite signal excluding at least one of the channels present at said generating operation; and applying variable gain to at least one of the plurality of frequency-translated bands of channels, the amount of gain being varied in order to balance the signal strength of each of the bands of channels within the frequency-division multiplexed composite signal.

20. The method of claim 19, wherein applying filtering comprises applying filtering to at least one of the first plurality of frequency-translated bands of channels either:

(i) prior to combining in the first stage said first plurality of frequency-translated bands of channels, (ii) subsequent to combining in the first stage said first plurality of frequency translated bands of channels; or (iii) both prior to and subsequent to combining in the first stage said first plurality of frequency-translated bands of channels.

21. The method of claim 19, wherein applying filtering comprises applying filtering to at least one of the second plurality of frequency-translated bands of channels either:

(i) prior to combining in the first stage said second plurality of frequency-translated bands of channels, (ii) subsequent to combining in the first stage said second plurality of frequency-translated band of channels; or (iii) both prior to and subsequent to combining in the first stage said second plurality of frequency-translated bands of channels.

* * * * *